US011892190B1

(12) United States Patent
Hurtubise et al.

(10) Patent No.: US 11,892,190 B1
(45) Date of Patent: Feb. 6, 2024

(54) FIELD-ASSEMBLED AIR CONVEYANCE APPARATUS, SYSTEMS AND METHODS

(71) Applicant: Dust Free, LP, Royce City, TX (US)

(72) Inventors: Fadi Hurtubise, Dallas, TX (US); Gregg W. Burnett, Royse City, TX (US); Claudio Santini, Houston, TX (US); Nicholas Raissis, Houston, TX (US)

(73) Assignee: Dust Free, LP, Royce City, TX (US)

( * ) Notice: Subject to any disclaimer, the term of this patent is extended or adjusted under 35 U.S.C. 154(b) by 93 days.

(21) Appl. No.: 17/643,226

(22) Filed: Dec. 8, 2021

(51) Int. Cl.
*F24F 13/02* (2006.01)

(52) U.S. Cl.
CPC ..... *F24F 13/0209* (2013.01); *F24F 13/029* (2013.01); *F24F 13/0245* (2013.01); *F24F 13/0272* (2013.01)

(58) Field of Classification Search
CPC ... F24F 13/0209; F24F 13/0245; F24F 13/029
See application file for complete search history.

(56) References Cited

U.S. PATENT DOCUMENTS

| | | | | |
|---|---|---|---|---|
| 3,563,278 | A * | 2/1971 | Schardein | F24F 13/0209 138/125 |
| 9,267,702 | B2 | 2/2016 | Santini et al. | |
| 10,151,507 | B2 | 12/2018 | Santini et al. | |
| 10,976,070 | B1 * | 4/2021 | Albers | F24F 13/0263 |
| 2006/0054235 | A1 * | 3/2006 | Cohen | B32B 5/022 138/149 |
| 2009/0293979 | A1 * | 12/2009 | Scott | F16L 9/22 138/155 |
| 2011/0215572 | A1 | 9/2011 | Boonstra | |
| 2014/0130932 | A1 * | 5/2014 | Jin | F28F 9/26 138/155 |

(Continued)

FOREIGN PATENT DOCUMENTS

| | | | |
|---|---|---|---|
| CA | 2835898 | A1 | 3/2015 |
| CA | 2865781 | A1 | 1/2016 |

OTHER PUBLICATIONS

MEP Academy Instructor, "Sheet Metal Seams", Sep. 26, 2020, MEP Academy, Webpage from website, URL: "https://mepacademy.com/sheet-metal-seams/#Pittsburgh%20Seams" (Year: 2020).*

*Primary Examiner* — Craig M Schneider
*Assistant Examiner* — David R Deal
(74) *Attorney, Agent, or Firm* — Fogarty LLP

(57) ABSTRACT

The present heating, ventilation and air conditioning (HVAC) air conveyance apparatus is plurality of panels adapted to be field-assembled to form the conveyance apparatus. These panels include a pair of first quadrilateral panels, each defining a right-angle flange extending from each of a pair of opposite edges and a pair of second quadrilateral panels, each defining a hemmed cleat along each of a pair of opposite edges. Each hemmed cleat is shaped and dimensioned to receive one of the first quadrilateral panel right-angle flanges to form the HVAC air conveyance apparatus. Also, HVAC unit mating flanges extending from each other edge of each of the first quadrilateral panels and/or from each other edge of each of the second quadrilateral panels, such that at least a pair of opposed peripheral HVAC unit mating flanges extend from each end of the HVAC air conveyance apparatus.

20 Claims, 11 Drawing Sheets

(56) References Cited

U.S. PATENT DOCUMENTS

| | | | | |
|---|---|---|---|---|
| 2014/0290783 | A1* | 10/2014 | Fanelli | F24F 13/0263 138/149 |
| 2015/0027582 | A1* | 1/2015 | Seyr | F16L 9/02 138/156 |
| 2015/0082826 | A1 | 3/2015 | Santini et al. | |
| 2015/0323106 | A1* | 11/2015 | Jarvis | F16L 9/19 138/111 |
| 2018/0112887 | A1* | 4/2018 | Fanelli | F24F 11/30 |

* cited by examiner

FIELD-ASSEMBLED AIR CONVEYANCE APPARATUS, SYSTEMS AND METHODS

TECHNICAL FIELD

The present disclosure relates generally to heating, ventilating and/or air conditioning (HVAC) systems and, more particularly, to field-assembled air conveyance apparatuses, such as field-assembled HVAC sheet metal transitions, and systems and methods related thereto.

BACKGROUND

When installing a cased air conditioning evaporator coil on the top, or other outlet, of a high Seasonal Energy Efficiency Ratio (SEER) furnace the inlet dimensions of the coil, may not be the same dimensions as the outlet of the furnace. In most cases the outlet of the furnace is smaller than the inlet of the coil and a reduction in air flow is created such that SEER ratings are not achieved. Furthermore, prescribed servicing of aforementioned appliances are restricted and in some cases not achievable, thus requiring a full disassembly/separation of the appliances to gain access to needed internal components.

Transitions, or the like, used to join an air handling unit, such as a furnace, and another unit, such as the aforementioned air conditioning evaporator coil, are formed from sheet metal in an off-site shop and transported to a job site. Shipping or other transport of such an open-ended transition, or the like, is problematic in that it is bulky and structurally unsound, alone. For example, it is often necessary to mount the transition on a palette which greatly increases shipping or transportation costs.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

The present invention is directed to systems and methods which provide a heating, ventilation and air conditioning (HVAC) air conveyance apparatus from a plurality of panels adapted to be field-assembled to form the conveyance apparatus. These panels may include a pair of first quadrilateral panels, each defining a right-angle flange extending from each of a pair of opposite edges and a pair of second quadrilateral panels, each defining a hemmed cleat along each of a pair of opposite edges. Each hemmed cleat is shaped and dimensioned to receive one of the first quadrilateral panel right-angle flanges to form the HVAC air conveyance apparatus. Also, HVAC unit mating flanges extending from each other edge of each of the first quadrilateral panels and/or from each other edge of each of the second quadrilateral panels, such that at least a pair of opposed peripheral HVAC unit mating flanges extend from each end of the HVAC air conveyance apparatus.

In accordance with some aspects, each hemmed cleat may have a butt end extending generally perpendicular from a face of the respective second quadrilateral panel and extend along, and spaced apart from, the respective edge of the pair of opposite edges of the respective second quadrilateral panel. A projecting lip extends from the butt end, generally parallel to the face of the respective second quadrilateral panel, toward the respective edge of the pair of opposite edges of the respective second quadrilateral panel, spaced apart from the face of the respective second quadrilateral panel a distance to define a first quadrilateral panel right-angle flange receptive hemmed cleat slot, sized to receive one of the first quadrilateral panel right-angle flanges. In accordance with some aspects, each hemmed cleat may further include a screw receptive pilot hole defined through the projecting lip and configured to receive a fastener to secure a first quadrilateral panel right-angle flange received in the hemmed cleat slot, to form the HVAC air conveyance apparatus. Also, in accordance with some aspects, each first quadrilateral panel right-angle flange may include a right-angle flange screw receptive pilot hole defined through the first quadrilateral panel right-angle flange, the right-angle flange screw respective pilot hole spaced to align with the screw receptive pilot hole defined through the projecting lip when the first quadrilateral panel right-angle flange is received in the hemmed cleat slot. This right-angle flange screw respective pilot hole may be sized to threadably receive the fastener to form the HVAC air conveyance apparatus.

In accordance with some aspects, each panel of the plurality of panels may be generally trapezoidal in shape, wherein each other edge of each first quadrilateral panel and each other edge of each second quadrilateral panel are trapezoidal bases for each panel and each edge of the pair of opposite edges of each first quadrilateral panel and each edge of the pair of opposite edges of each second quadrilateral panel are trapezoidal legs for the respective panel. In accordance with some more specific aspects, each panel of the plurality of panels may generally be isosceles trapezoidal in shape.

In accordance with some aspects, at least one of the panels may include an access door. An air purification coating may be disposed on an inner surface of each panel forming the HVAC air conveyance apparatus. In other aspects, insulation panels may be disposed on an inner surface of each panel, and an air purification coating may be disposed on an inner surface of the insulation panels and thus on an inner surface of the HVAC air conveyance apparatus. Each panel may be made of sheet metal, which may be galvanized, aluminum, stainless steel, powder coated steel, pre-painted steel, or other iron-carbon alloy combination.

The present (HVAC) air conveyance apparatus may be assembled by assembling a pair of first quadrilateral panels to a pair of second quadrilateral panels to form the HVAC air conveyance apparatus, by inserting a right-angle flange extending from each of a pair of opposite edges of each of the first quadrilateral panels into a hemmed cleat defined along each of a pair of opposite edges of each of a respective one of the second quadrilateral panels. Each of the first quadrilateral panels may be secured to the respective one of the second quadrilateral panels with a fastener received through a pilot hole defined through a projecting lip of the hemmed cleat of each of the second quadrilateral panels into the right-angle flange extending from the respective one of the first quadrilateral panels.

Also, in accordance with some aspects, preparing the pair of first quadrilateral panels and the pair of second quadrilateral panels for transportation, prior to assembly, may include alternately stacking one of the first quadrilateral panels, one of the second quadrilateral panels, the other of the first quadrilateral panels, and the other of the second quadrilateral panels.

In accordance with some aspects, the fastener received through the pilot hole defined through the projecting lip of the hemmed cleat of each of the second quadrilateral panels may also be into a screw receptive pilot hole defined in the right-angle flange extending from the respective one of the first quadrilateral panels.

In accordance with some further aspects, a resultingly assembled HVAC air conveyance apparatus may be disposed between a first HVAC unit and a second HVAC unit, with HVAC unit mating flanges extending from each other opposite edge of each first and/or second quadrilateral panels received securely by an open end of each of the first and second HVAC units. The assembled HVAC air conveyance apparatus may then be secured between the first HVAC unit and the second HVAC unit air conveyance apparatus using a plurality of fasteners through the HVAC unit mating flanges.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated that the conception and specific embodiment disclosed may be readily utilized as a basis for modifying or designing other structures for carrying out the same purposes of the present invention. It should also be realized that such equivalent constructions do not depart from the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

Figure 1:
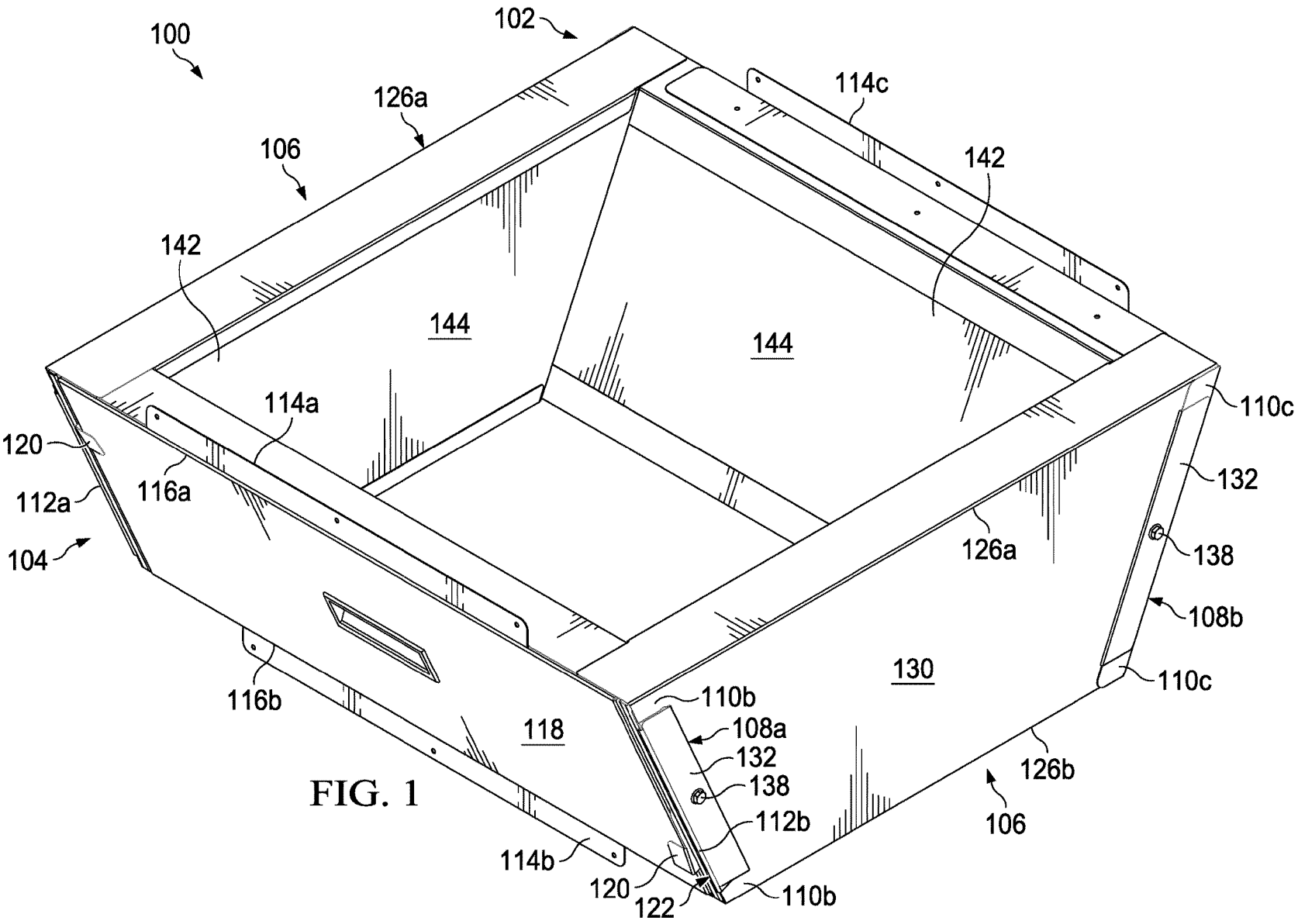
Figure 2:
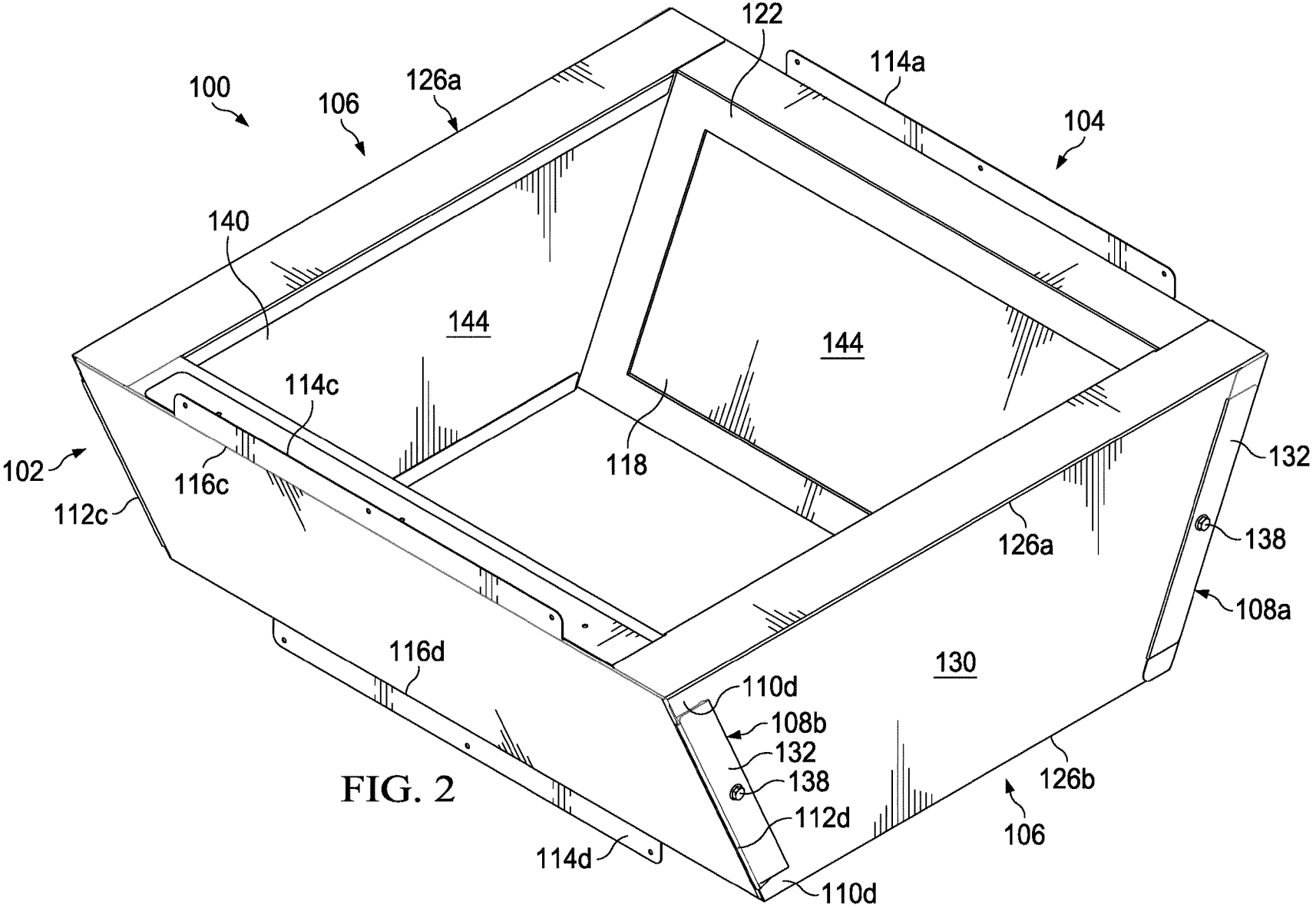
Figure 3:
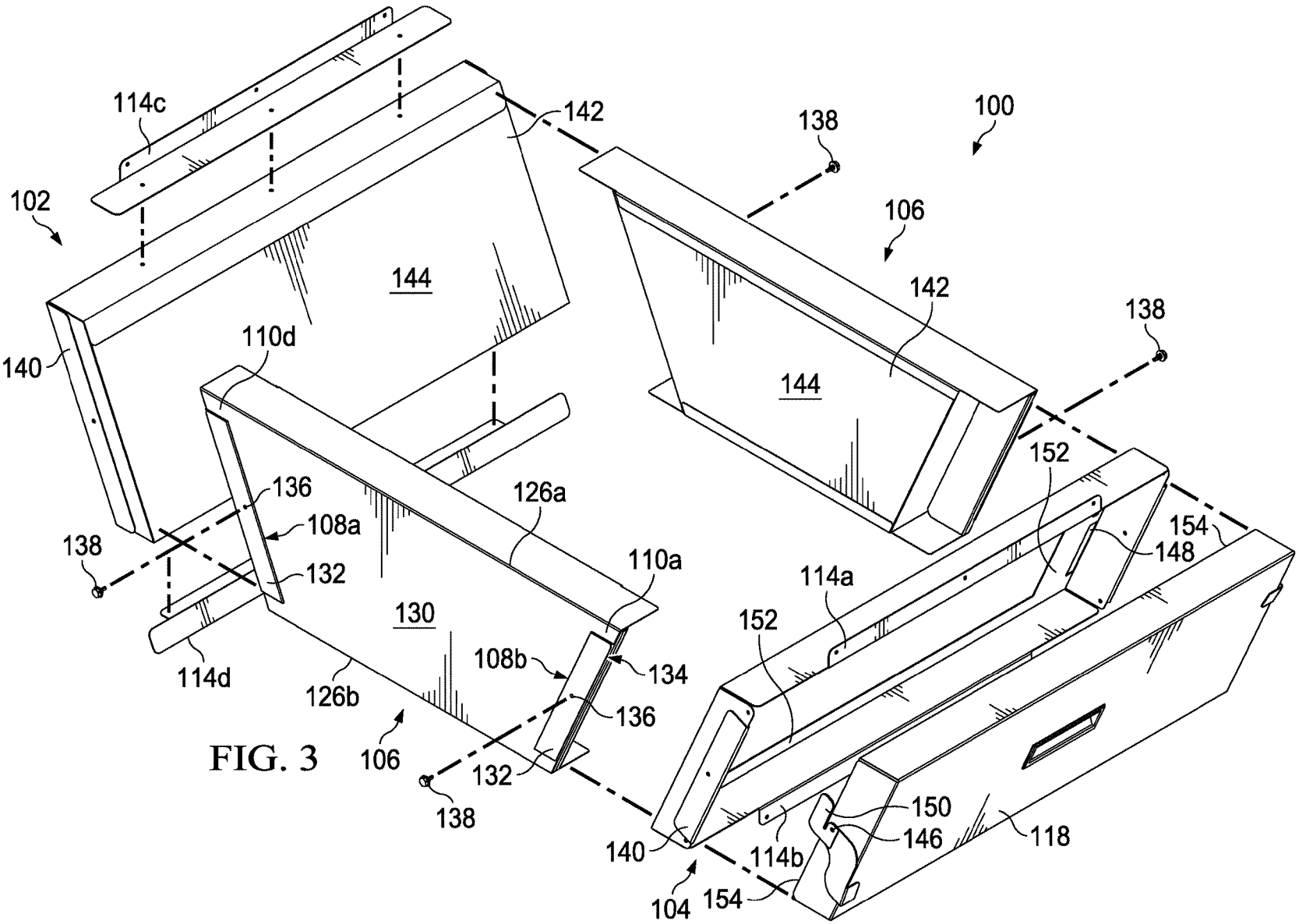
Figure 4:
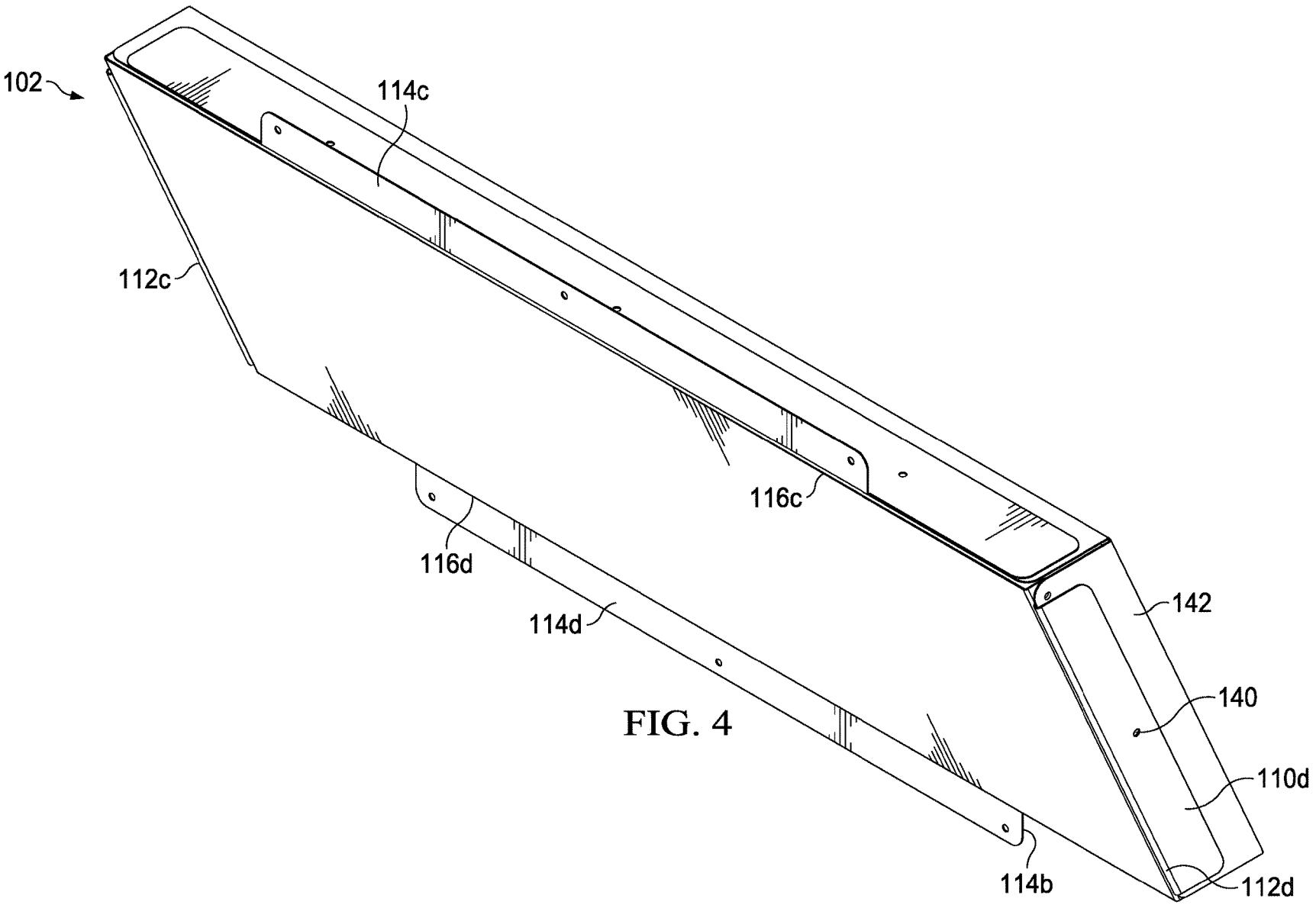
Figure 5:
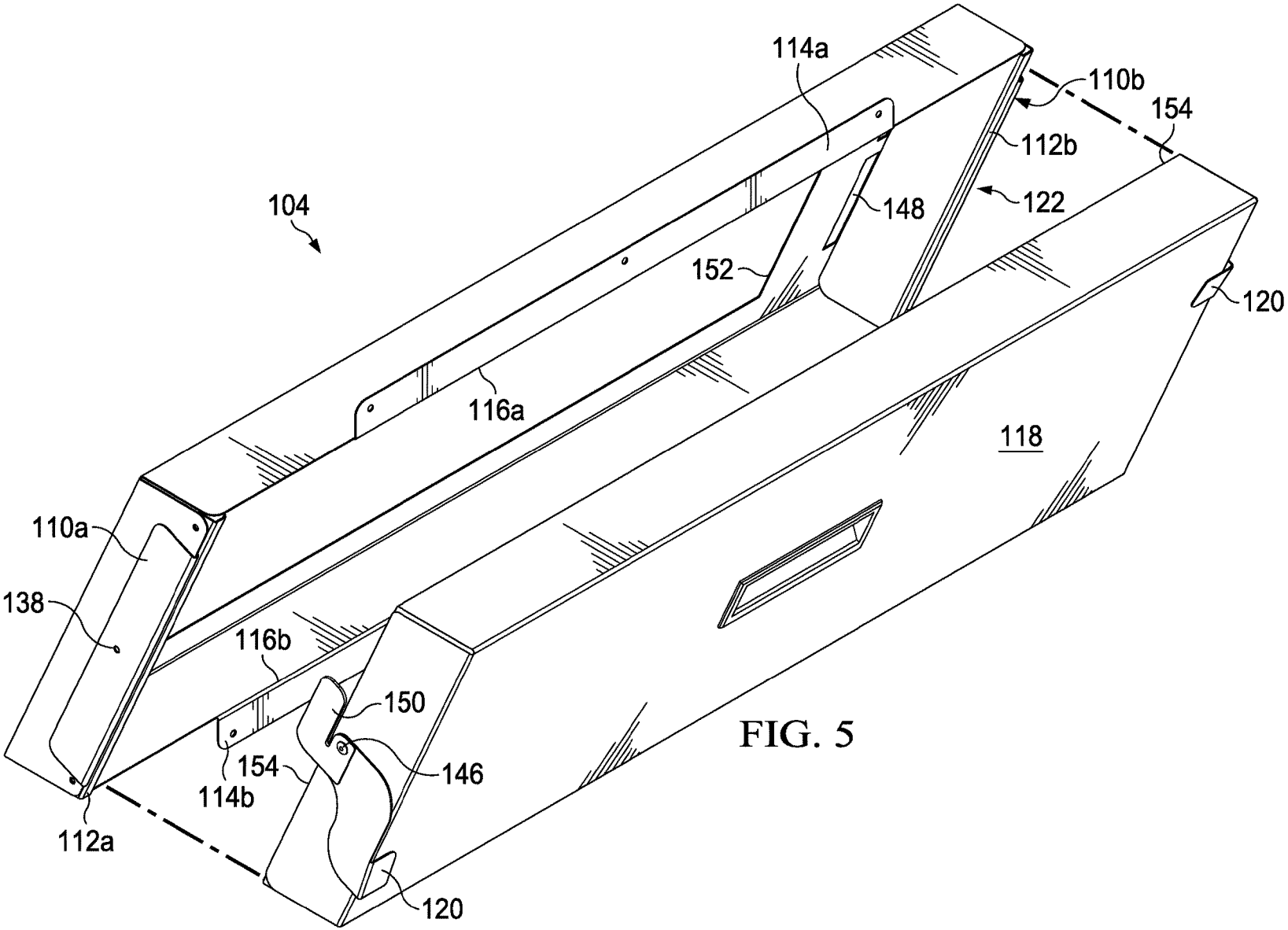
Figure 6:
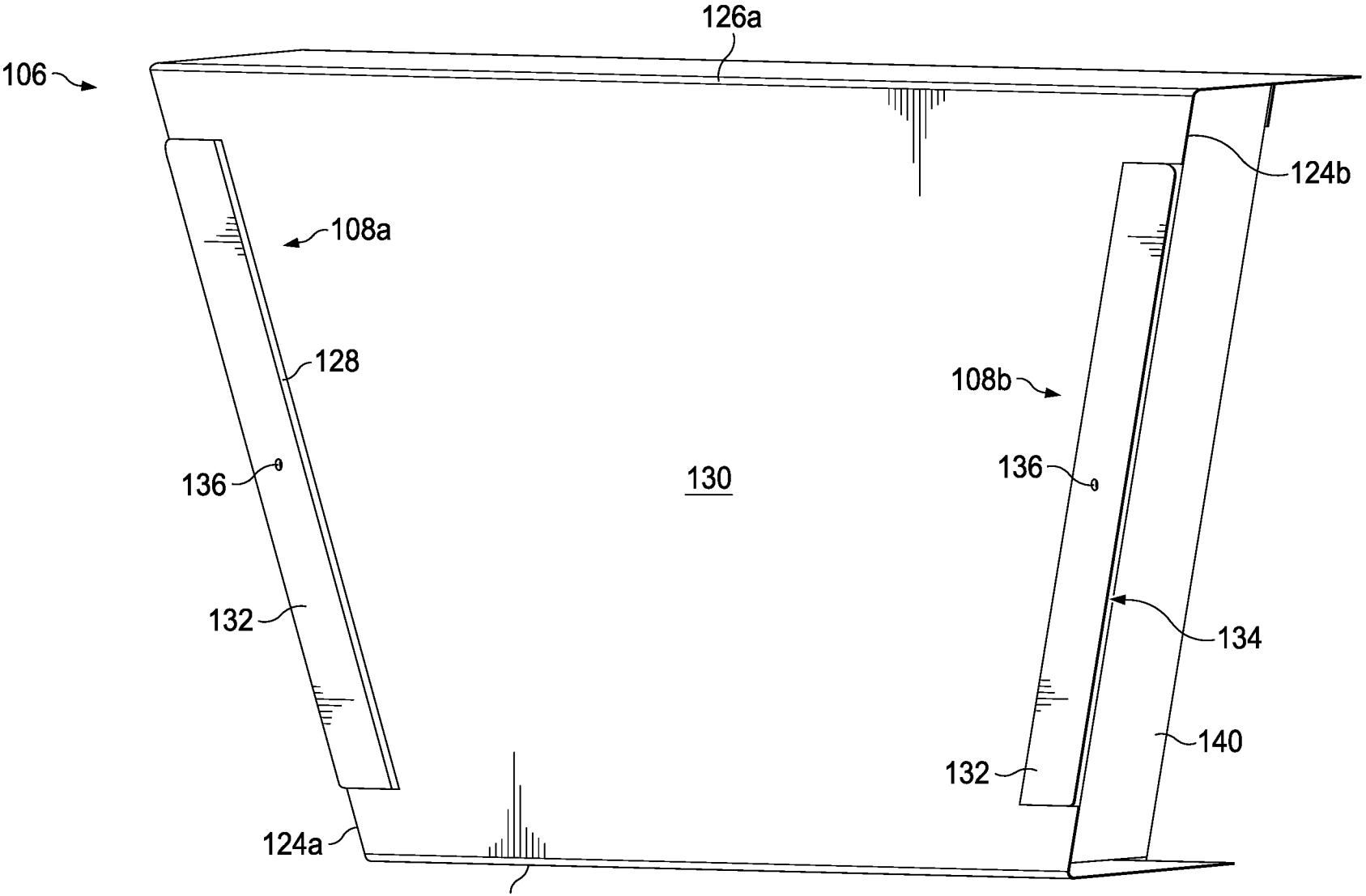
Figure 7:
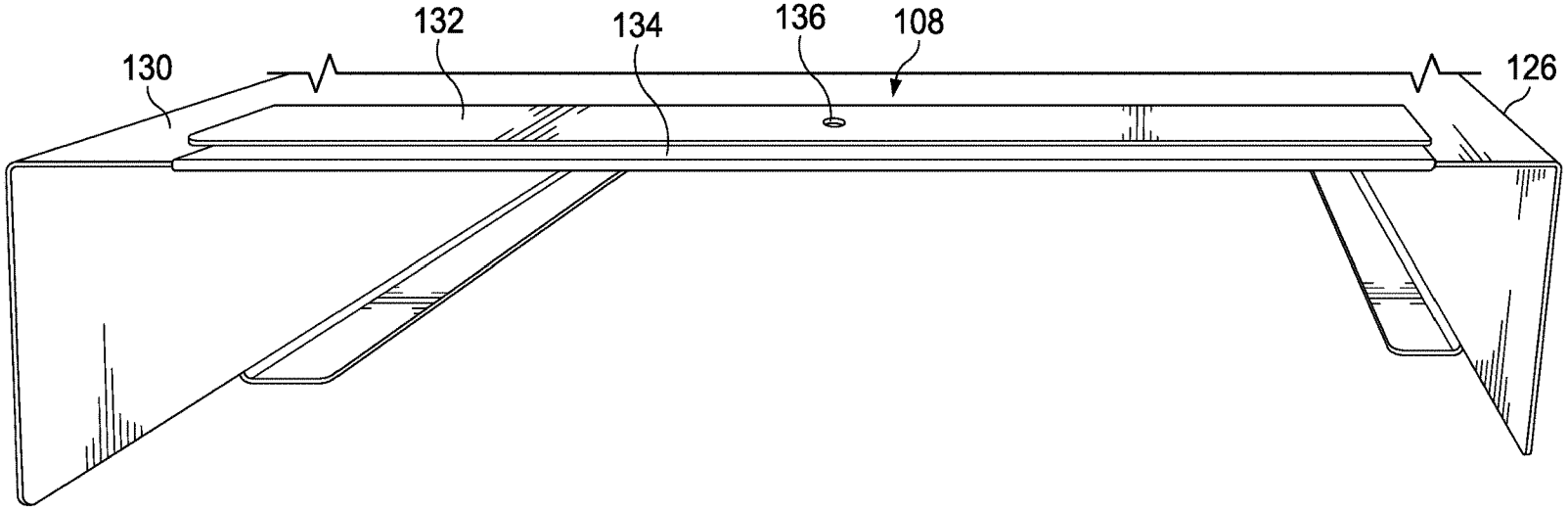
Figure 8:
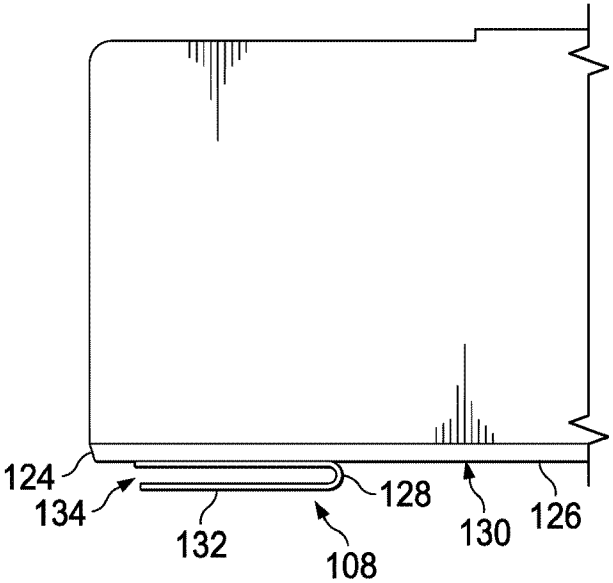
Figure 9:
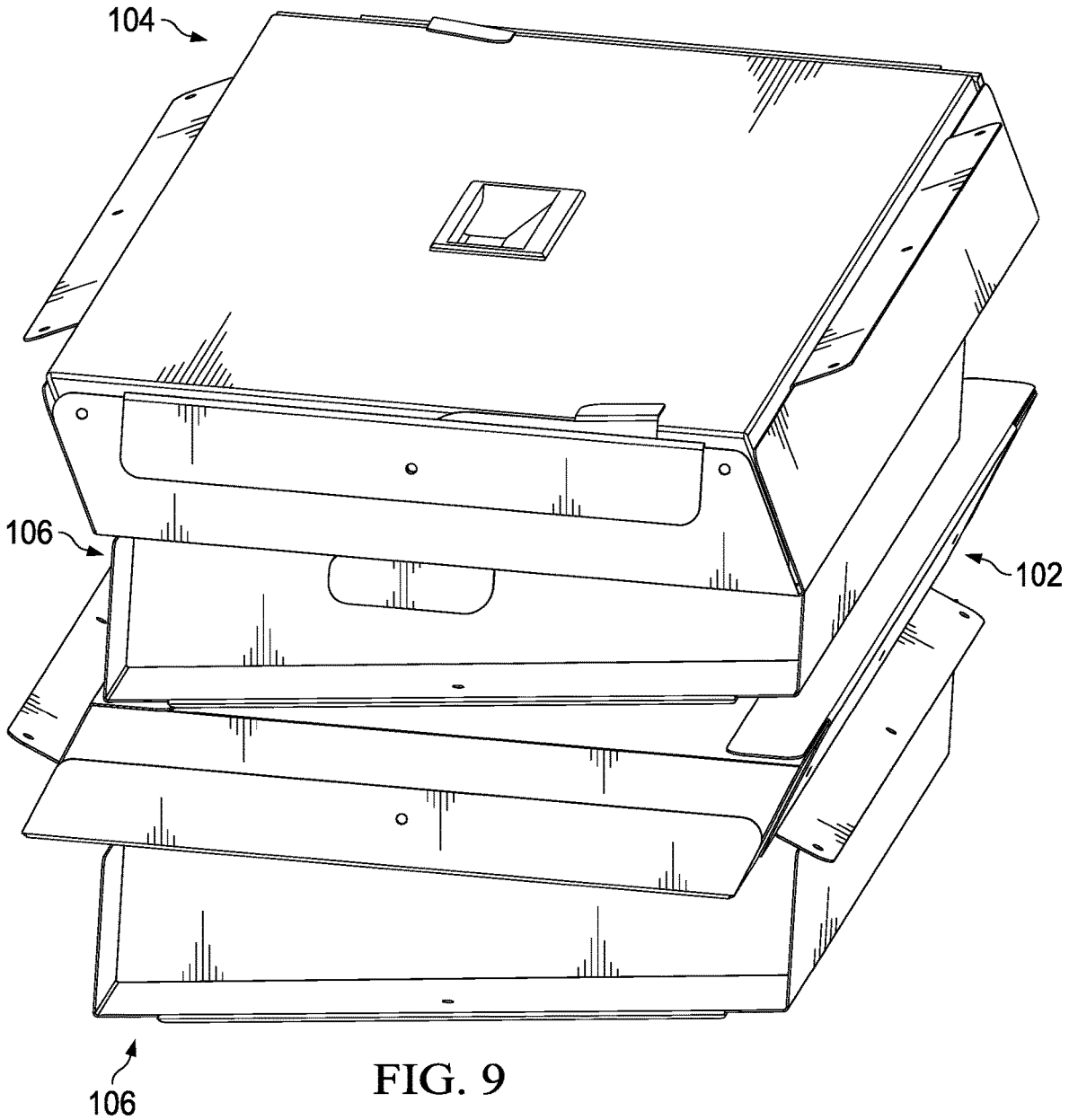
Figure 10:
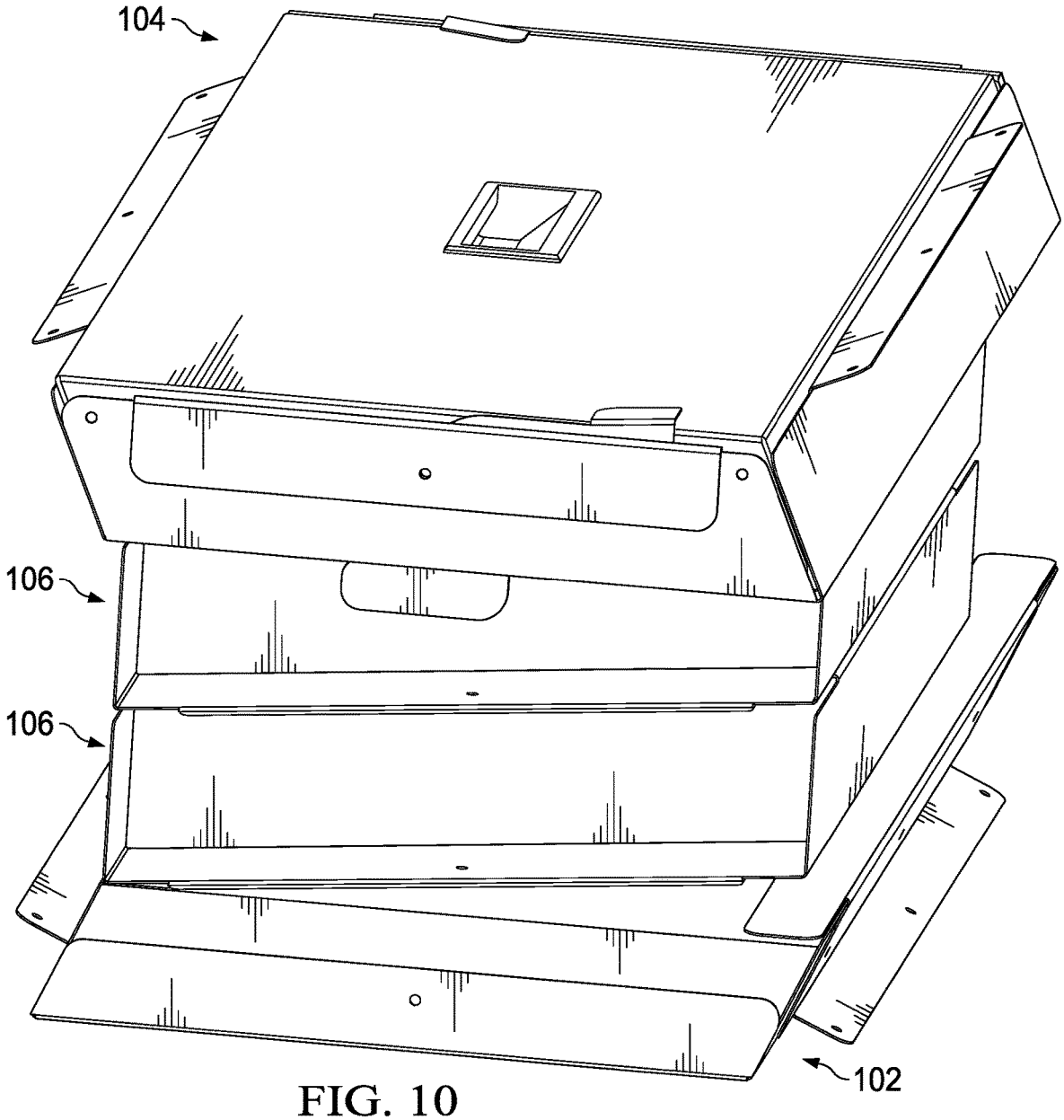
Figure 11:
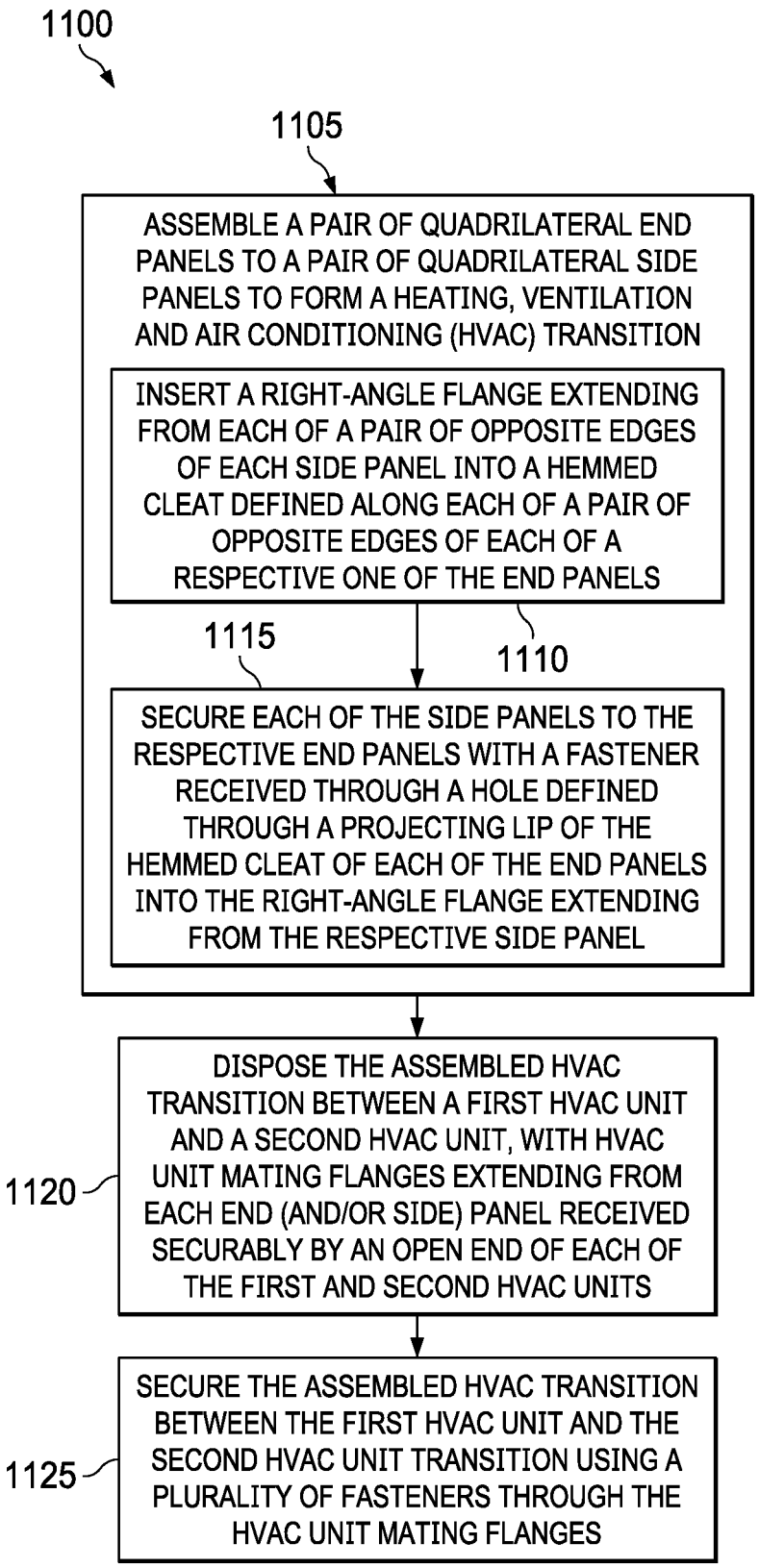
Figure 12:
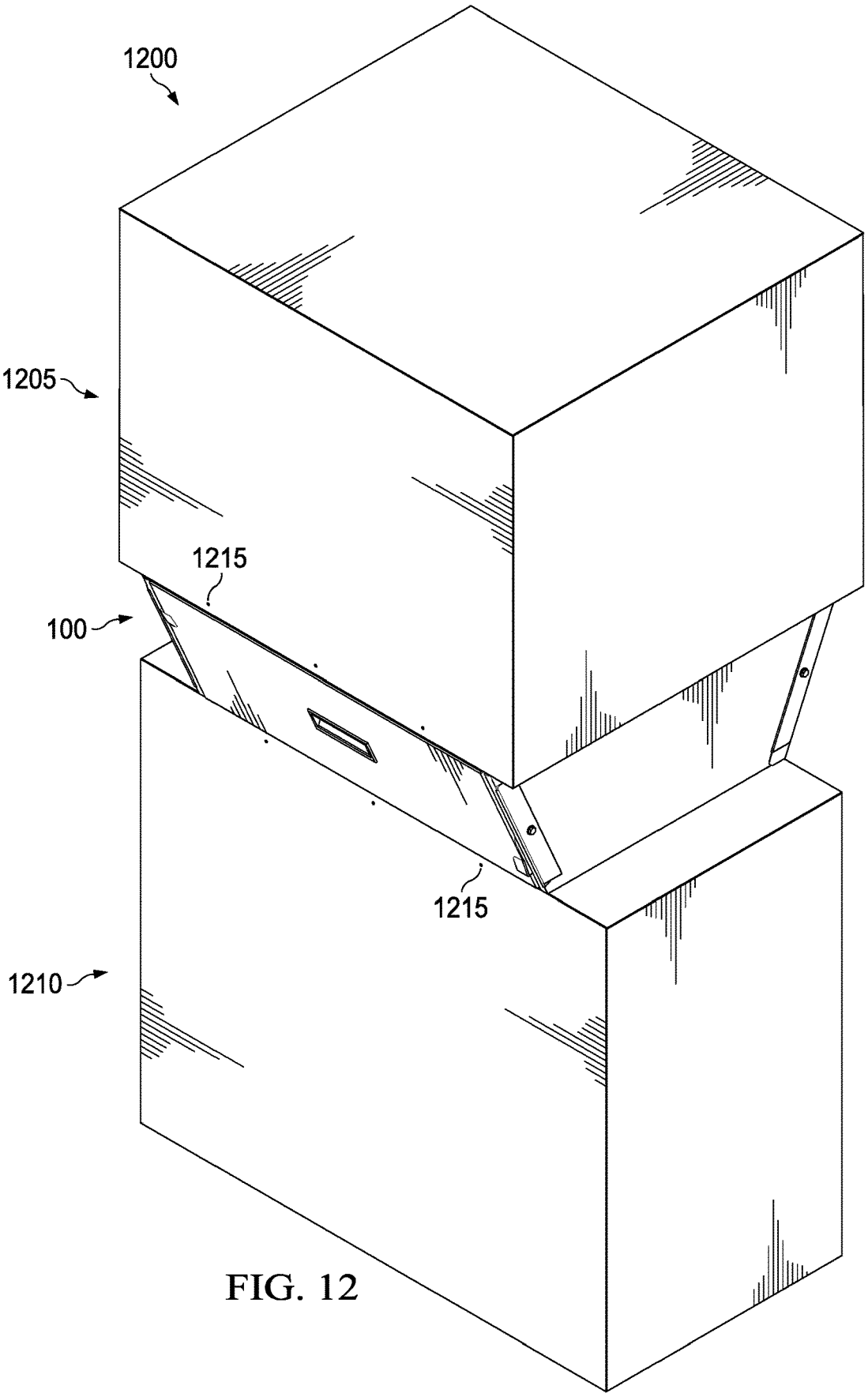

Having thus described the invention in general terms, reference will now be made to the accompanying drawings, which are not necessarily drawn to scale, and wherein:

FIG. 1 is a front side perspective view of an example of a combined component field-assembled sheet metal heating, ventilation and air conditioning (HVAC) air conveyance apparatus, according to some embodiments;

FIG. 2 is an opposite, rear side perspective view of the example combined component field-assembled sheet metal HVAC air conveyance apparatus of FIG. 1, according to some embodiments;

FIG. 3 is a partially exploded perspective view of a combined component field-assembled sheet metal HVAC air conveyance apparatus, according to some embodiments;

FIG. 4 is a perspective view of an example solid end component panel for a field-assembled sheet metal HVAC air conveyance apparatus, according to some embodiments;

FIG. 5 is a perspective view of an example doored end component panel for a field-assembled sheet metal HVAC air conveyance apparatus, according to some embodiments;

FIG. 6 is a perspective view of an example side component panel for a field-assembled sheet metal HVAC air conveyance apparatus, according to some embodiments;

FIG. 7 is an enlarged perspective view of an example hemmed cleat employed in the panels of FIGS. 1 thorough 6, according to some embodiments;

FIG. 8 is a further enlarged end view of an example hemmed cleat employed in the panels of FIGS. 1 thorough 6, according to some embodiments;

FIG. 9 is perspective view of the example doored end component panel of FIG. 5, one example side component panel of FIG. 6, the example solid end component panel, of FIG. 4 and another example side component panel of FIG. 6 stacked, according to some embodiments;

FIG. 10 is perspective view of the example doored end component panel of FIG. 5, two example side component panels of FIG. 6 and the example solid end component panel, of FIG. 4 and stacked, according to some embodiments;

FIG. 11 is flowchart of a process for field-assembly of a sheet metal HVAC air conveyance apparatus, according to some embodiments; and FIG. 12 is a perspective diagrammatic view of a HVAC system employing an embodiment of the present field-assembled sheet metal air conveyance apparatus, according to some embodiments.

While this specification provides several embodiments and illustrative drawings, a person of ordinary skill in the art will recognize that the present specification is not limited only to the embodiments or drawings described. It should be understood that the drawings and detailed description are not intended to limit the specification to the particular form disclosed, but, on the contrary, the intention is to cover all modifications, equivalents and alternatives falling within the spirit and scope of the claims. Also, any headings used herein are for organizational purposes only and are not intended to limit the scope of the description. As used herein, the word "may" is meant to convey a permissive sense (i.e., meaning "having the potential to"), rather than a mandatory sense (i.e., meaning "must"). Similarly, the words "include," "including," and "includes" mean "including, but not limited to."

DETAILED DESCRIPTION

The invention now will be described more fully hereinafter with reference to the accompanying drawings. This invention may, however, be embodied in many different forms and should not be construed as limited to the embodiments set forth herein. Rather, these embodiments are provided so that this disclosure will be thorough and complete, and will fully convey the scope of the invention to those skilled in the art. One skilled in the art may be able to use the various embodiments of the invention.

As noted, one of the challenges that heating, ventilating and/or air conditioning (HVAC) contractors are faced with when installing a cased coil on the top, or at the outlet, of a high Seasonal Energy Efficiency Ratio (SEER) furnace is that the inlet dimensions of the coil, are not the same dimensions as the outlet of the furnace. Similar problems arise when the inlet of the furnace is installed at the outlet of the coil. Either such installation may use a transition, or the like disposed between the units. In most cases the outlet of the furnace is smaller than the inlet of the coil and a reduction in air flow is created such that SEER ratings are not achieved or compromised, and thus, total system efficiency is hampered, distribution of thermal dynamic properties are compromised and designed or intended heat transfer and flow distributions characteristics are compromised. Transitions may also be used in laboratories, to connect testing ductwork or instrumentation to various types of air handlers, heating units, cooling units, or the like.

Embodiments herein relate generally to HVAC systems and, more particularly, to field-assembled air conveyance apparatuses, such as field-assembled HVAC sheet metal transitions, and systems and methods related thereto. Herein, embodiments of a field-assembled (insulated) sheet metal to field-assembled air conveyance apparatus, such as a sheet metal transition that is adapted to be install in between the outlet of a furnace (or other forced air hander) and a cased air conditioning evaporation coil, are disclosed.

In accordance with embodiments of the present field-assembled (insulated) sheet metal air conveyance apparatus systems and methods, a plurality of panels are adapted to be field-assembled to form the air conveyance apparatus. These panels may include a pair of first quadrilateral panels, each defining a right-angle flange extending from each of a pair of opposite edges and a pair of second quadrilateral panels, each defining a hemmed cleat along each of a pair of opposite edges. Each hemmed cleat is shaped and dimensioned to receive one of the first quadrilateral panel right-angle flanges to form the air conveyance apparatus. Also, HVAC unit mating flanges may extend from each other edge of each of the first quadrilateral panels and/or from each other edge of each of the second quadrilateral panels, such that at least a pair of opposed peripheral HVAC unit mating flanges extend from each end of the HVAC air conveyance apparatus.

Embodiments of the present field-assembled (insulated) sheet metal air conveyance apparatus are a knockdown multi-panel unit, which is adapted to be packaged, transported, and dispatched in a minimized footprint configuration. Embodiments of the unit utilize a series of flange and hem fasteners, such that the unit can be field-assembled at the site of the application, utilizing minimal tools. The panels used in accordance with the present systems and methods are sized for many configurations for various application conformity.

The panel walls can be secured in place using a series of fitted material bends that allow one flange to be inserted into an adjacent panel's open hem. Furthermore, a (single) securing screw can lock the panels together. In various embodiments, the unit includes a fibrous insulation, which when coupled with the application appliance, improves sound-deadening properties, R-value properties, resistance to moisture and biology, and fire safety. After assembly, the double open-ended air conveyance apparatus can be placed between "inappropriately" sized and "non-conforming" air systems (i.e., cased oils, furnaces or other air handlers that that have different dimensioned outlet and in inlet openings, as duct transitions, in laboratory air handling testing application configurations, or the like).

FIG. 1 is a front side perspective view of example combined component field-assembled sheet metal air conveyance apparatus (e.g., a transition) 100, and FIG. 2 is an opposite, rear side perspective view of example combined component field-assembled sheet metal air conveyance apparatus 100, according to some embodiments. FIG. 3 is a partially exploded perspective view of combined component field-assembled sheet metal HVAC air conveyance apparatus 100, according to some embodiments. Combined component field-assembled sheet metal air conveyance apparatus 100 includes solid end component panel 102, which in illustrated embodiment 100 forms the back (i.e., serves as the rear panel) of the combined component field-assembled sheet metal air conveyance apparatus. FIG. 4 is a perspective view of example solid end component panel 102, according to some embodiments. Doored end component panel 104 forms a front of field-assembled sheet metal air conveyance apparatus 100. FIG. 5 is a perspective view of example doored end component panel 104, according to some embodiments. In other embodiments, a combined component field-assembled sheet metal air conveyance apparatus may comprise two solid end component panels 102, rather than one each of solid end component panel 102 and doored end component panel 104. Regardless, the combined component field-assembled sheet metal air conveyance apparatus, such as illustrated combined component field-assembled sheet metal air conveyance apparatus (e.g., a transition) 100, also includes two, opposite side component panels 106. FIG. 6 is a perspective view of example side component panel 106 for field-assembled sheet metal air conveyance apparatus 100, according to some embodiments. Side component panels 106 may be symmetrical, such as illustrated in FIGS. 1, 2 and 5, and thereby interchangeable for field-assembly of a sheet metal air conveyance apparatus in accordance with embodiments of the present systems and methods. However, in other embodiments under the present systems and methods, side component panels may not be symmetrical, for example side panels that are asymmetrical may be "dimensionally reflective" such that corresponding edges are aligned. As discussed in greater detail below, embodiments of the present field-assembled sheet metal air conveyance apparatus may make use of hemmed cleats 108. FIG. 7 is an enlarged perspective view of example hemmed cleat 108 employed in the panels of FIGS. 1 thorough 5, and FIG. 8 is a further enlarged end view of example hemmed 108, according to some embodiments. The hemmed cleat accepts any properly sized flange within the opening and then is able to be secured with a fastener to hold the two panels together.

Thus, with attention directed to FIGS. 1 through 7, an embodiment of HVAC air conveyance apparatus (e.g., a transition) 100 may include a plurality of each of panels 102 and 106, but in some embodiments one of each side panel 102 and 104 and two of end panels 106. Regardless, panels 102, 104 and 106 are adapted to be field-assembled to form HVAC air conveyance apparatus (e.g., a transition) 100. Each panel may be formed out of sheet metal, such as galvanized steel, aluminum, stainless steel, powder coated steel, pre-painted steel, other iron-carbon alloy combination, or the like, or may be formed out of other materials such as a plastic or other polymer. In some embodiments, air conveyance apparatus 100 may be assembled using, by way of example, only four fasteners.

The plurality of panels includes a pair of first quadrilateral panels, end panels 102 and 104. In accordance with various embodiments, each first quadrilateral (end) panel 102 or defines a right-angle (i.e., generally 90 degree) flange 110*a* through 110*d* extending, generally inward, as illustrated in FIGS. 3 and 4, from each of a pair of opposite edges 112*a* through 112*d*. Each of end panels 102 and 104 may also define HVAC unit mating flanges 114*a* through 114*d* extending from each other edge 116*a* through 116*d* of each first quadrilateral (end) panel 102 and 104, respectively. As shown in FIG. 5, at least one of the panels making up air conveyance apparatus (e.g., a transition) 100 may have an HVAC component access door 118. For example, FIG. 5 shows end panel 104 with HVAC component access door 118. Retaining latches 120, as shown in FIG. 5, or other mechanisms, may be used to removably secure door 118 (closed) on panel 104. For example, as discussed in greater detail below door 118 may be fastened to (peripherical) door frame 122 of panel 104 by means of latches 120. Latches 120 may swivel about a concentric point (on the (insulated) door) with a predetermined rotational degree of freedom.

The aforementioned plurality of panels making up HVAC air conveyance apparatus (e.g., a transition) 100 also includes a pair of second quadrilateral panels, side panels 106. As best seen in FIG. 6, each second quadrilateral (side) panel 106 defines hemmed cleat 108*a* or 108*b* along each of a pair of opposite edges 124*a* and 124*b*. While not shown in FIGS. 1 through 7, side panels 106 may also define HVAC unit mating flanges, similar to HVAC mating flanges 114 of end panels 102 and 104, extending from each other edge 126*a* and 126*b* of each second quadrilateral (side) panel. Each hemmed cleat 108 is shaped and dimensioned to snuggly (e.g., within a functional snug fit tolerance) receive one of the first quadrilateral panel right-angle flanges 110 to form HVAC air conveyance apparatus 100, with peripheral HVAC unit mating flanges 114 extending from each end of assembled HVAC air conveyance apparatus 100, as best seen in FIGS. 1 and 2.

With attention directed to FIGS. 6 and 7, each hemmed cleat 108 has, in accordance with various embodiments, hem butt end 128 extending generally perpendicular from face 130 of the respective second quadrilateral (side) panel 106, and along and spaced apart from, respective edge 124 of the second quadrilateral (side) panel. The integral hemmed cleat 108 further defines projecting lip 132 extending from hem butt end 128, generally parallel to face 130 of the respective second quadrilateral (side) panel, toward respective edge 124, and spaced apart from face 130 a distance to define hemmed cleat slot 134. Open hem thickness slot 134 is sized to snug fit receive first quadrilateral (end) panel right-angle flange 110. Each of hemmed cleats 108 may has screw receptive hole 136 defined through projecting lip 132. Screw receptive hole 136 may be pilot hole, sized to receive fastener 138 to secure first quadrilateral panel right-angle flange 110 received in hemmed cleat slot 134 in the hemmed cleat slot, to form HVAC air conveyance apparatus (e.g., a transition) 100. Correspondingly, in some embodiments, each first quadrilateral (end) panel right-angle flange 110 may have a smaller right-angle flange screw receptive pilot hole 140 defined through the right-angle flange. This right-angle flange screw receptive pilot hole is spaced along right-angle flange 110 to align with screw receptive pilot hole 136 defined through projecting lip 132 of hemmed cleat 108 when the right-angle flange is received in hemmed cleat slot 134 defined by the projecting lip. Further, smaller right-angle flange screw receptive pilot hole 140 may be sized (smaller than hemmed cleat screw receptive pilot hole 136) to threadably receive fastener 138 to form HVAC air conveyance apparatus 100. In such embodiments fastener 138 may be a self-threading, self-tapping, self-drilling, or similar screw, or the like. However, in other embodiments, right-angle flange 110 may not define a screw receptive pilot hole, and in such embodiments the fastener may be a drill screw, which may be disposed through hemmed cleat screw receptive pilot hole 136 defined through projecting lip 132 and drill-screwed into right-angle flange 110 to form HVAC air conveyance apparatus 100.

Returning to FIGS. 1 through 5, as noted each panel of the plurality of panels 102, 104 and 106 may, in accordance with embodiments of the present systems and methods, be generally quadrilateral in shape. Some panels may further be trapezoidal in shape. For example, each edge 124 of the pair of opposite edges of each second quadrilateral (side) panel are illustrated as trapezoidal legs for the respective panel. Also, correspondingly, each of other edge 126 of each second quadrilateral side panel are illustrated as trapezoidal bases for each respective panel. In various embodiments each such trapezoidal panel may generally have an isosceles trapezoidal shape. That is, where base angles have the same measure, the two legs, edge pairs 124*a* and 124*b* are of equal length and each respective panel has reflection symmetry. In some embodiments some or all of the panels may be rectangular (or square) in shape.

As shown in FIGS. 1 through 5, (rigid) insulation (panels) 142, such as certified insulation panels, or the like, may be disposed (e.g., secured, glued, compression fit, pinched, wedged via application of flange after having inserted the insulation, cupped head (weld) pinned, and/or the like) on an inner surface of each panel 102, 104 and 106 of the plurality of panels forming HVAC air conveyance apparatus (e.g., a transition) 100, including, in some embodiments (not shown) on an inner surface of door 118. The insulation panels may have a pressure sensitive adhesive applied foil laminate surface, or other reflective layer such as foil with radiation insulation properties. Alternatively, spray foam insulation may be sprayed on the inner surface of the panels, rather than insulation panels being adhered or affixed thereto. In such embodiments, air purification coating 144 may be disposed on an inner surface of insulation panels 142 and thus on an inner surface of the HVAC air conveyance apparatus 100 in contact with airflow through the installed air conveyance apparatus. In embodiments where insulation panels 142 are not employed an air purification coating may be disposed directly on the inner surface of each panel 102, 104 and 106, of the plurality of panels forming the HVAC air conveyance apparatus, including on an inner surface of door 118, in contact with airflow through the installed air conveyance apparatus. For example, Manganese dioxide, such as in combination with Titanium dioxide, may be used to coat interior surfaces of air conveyance apparatus 100. Manganese dioxide exhibits thermocatalytic activity for the decomposition of organic pollutants. Coupling Titanium dioxide with Manganese dioxide degrades organics further than Titanium dioxide alone, due to the thermocatalytic activity of Manganese dioxide. Further, one or more of the panels (e.g., side panels 106) may include prefabricated (pilot) holes (not shown) which allow an operator or installer to quickly mount an in-duct filter, air purifier, germicidal (ultra-violet (UV)) lamp, disinfecting technology, or the like (not shown) in HVAC air conveyance apparatus 100. These prefabricated (pilot) holes may be accompanied by a "call out" that can be a sticker (over the prefabricated (pilot) holes), metal engraving, laminate, painted, etc. (not shown).

With particular attention directed to FIGS. 3 and 5, as noted, at least one of the panels making up air conveyance apparatus (e.g., a transition) 100 may have an HVAC component access door 118. FIG. 5 shows end panel 104 with HVAC component access door 118.

Retaining latches 120 in FIG. 5 removably secure door 118 (closed) to panel door frame 122 of panel 104. As noted, door 118 may be fastened to (peripherical) door frame 122 of panel 104 by means of latches 120, such as by each of latches 120 swiveling about a concentric point 146, on (insulated) door 118) a predetermined amount, such as generally about ninety degrees. Door frame 122 may define door frame slots 148 for receiving the jaw section 150 of latches 120. This door latching mechanism may provide "stay-locked" features to combat pressure variances that may otherwise cause door 118 to (unlatch and) open, unlike prior latches where there is minimal resiliency to forces that may cause the door latch to rotate to an open position when a load is applied to the door, thus triggering the door to leak or freely open during operation. When a positive internal pressure is applied within air conveyance apparatus 100, torque is applied from door frame 122 to latch (arm) 120 that causes it to rotate further into the "locking" direction (i.e., toward inside frame ledge 152). For example, in accordance with embodiments, when assembled and installed conveyance apparatus 100 is exposed to a positive internal pressure acting on the inside of door 118, the edge of the slot (148)

in door frame 122 imposes a force onto the arm portion of latch 150. This tangential force acting on the latch arm (150) is a predetermined distance away from fastener 146, thereby acting as a moment arm. The resulting torque thereby applied to latch 120 causes the latch to be rotationally forced into its locking, or securing, position inside of slot 148. This torque can be overcome by a human operator applying an opposing torque on the latch by means of the latch tab, thereby causing the latch to rotate into an "un-locked" position before servicing. Door 118, and frame 122, may be sized such that removal of door 118, by release of laches 120, may, may remove (almost) an entire face of assembled air conveyance apparatus 100. Door 118 is fit to bottom out on inside ledge 152 of door frame 122 so as to seal against leakage of air. The combined, or complementary, geometry of door 188, frame 122 and/or frame ledge 152 may enable compression of insulation 142, such that the insulation acts as a gasket, or enable a flush sheet metal on sheet metal edge between door edge 154 and inside frame ledge 152.

In accordance with various embodiments of the present systems and methods, panels 102, 104 and 106 may be prepared for shipment into the field and eventual assembling into air conveyance apparatus (e.g., a transition) 100 by (alternately) stacking the pair of first quadrilateral (end) panels 102 and 104 with the pair of second quadrilateral (side) panels 106, in various configurations. Thereby, embodiments of the present field-assembled sheet metal air conveyance apparatus save on shipping costs, particularly as compared to one piece, or fully assembled air conveyance apparatus. FIG. 9 is perspective view of example doored end component panel 104 of FIG. 5, one example side component panel 106 of FIG. 6, example solid end component panel 104 of FIG. 4 and another example side component panel 106 of FIG. 6 stacked for shipment into the field for filed assembly of air conveyance apparatus 100, according to some embodiments. Also, in accordance with various embodiments of the present systems and methods, panels 102, 104 and 106 may be prepared for shipment into the field and eventual assembling into air conveyance apparatus 100 by stacking the panels with doored end panel 104 and solid (back) end panel 102 are on the outside of the stack with the (two) side panels 106 disposed between, such as illustrated in FIG. 10.

FIG. 11 is flowchart of process 1100 for field-assembly of a sheet metal air conveyance apparatus (100) (and its use in an HVAC system (1000)), according to some embodiments. Initially, the panels (102, 104 and 106) to be used in the air conveyance apparatus (e.g., a transition) are unstacked and at 1105 a pair of first (end) quadrilateral panels (102 and 104) are assembled to a pair of second (side) quadrilateral panels (106) to form a HVAC air conveyance apparatus (100). Assembly at 1105 is carried out by, at 1110, inserting a right-angle flange (110) extending (inward) from each of a pair of opposite edges (112) of each of the first (end) quadrilateral panels (102 or 104) into a hemmed cleat (108) defined along each of a pair of opposite edges (124) of each of a respective one of the second (side) quadrilateral panels; 106. Then, at 1115, each of the first quadrilateral (end) panels (102 and 104) is secured to the respective one of the second quadrilateral (side) panels (106) with a fastener (138) received through a pilot hole (136) defined through a projecting lip (132) of the hemmed cleat (108) of each of the second quadrilateral (end) panels into the right-angle flange (110) extending from the respective one of the first quadrilateral (side) panels. Securing the panels at 1115 may include, by way of example receiving the fastener (138) through the fastener receptive pilot hole (136) defined through the projecting lip (132) of the hemmed cleat (108) of each of the second quadrilateral (side) panels (106) into a screw receptive pilot hole (140) defined in the right-angle flange (110) extending from the respective one of the first second quadrilateral (end) panels (102 or 104).

FIG. 12 is a perspective diagrammatic view of HVAC system 1200 employing an embodiment of the present field-assembled sheet metal air conveyance apparatus (e.g., a transition) 100, according to some embodiments. Therein, HVAC system 1200 includes first HVAC unit 1205, which may be an air handling unit, such as a gas or electric furnace, or the like, and second HVAC unit 1210, which may be a set of cased air conditioning evaporator coils, or the like. An embodiment of the present field-assembled sheet metal HVAC air conveyance apparatus 100, such as described above, is disposed between, and secured to, first HVAC unit 1205 and second HVAC unit 1210. Alternatively, first HVAC unit 1205 may be a set of cased air conditioning evaporator coils, or the like, and second HVAC unit 1210 may be an air handling unit, such as a gas or electric furnace, or the like. An embodiment of the present field-assembled sheet metal HVAC air conveyance apparatus 100, such as described above, is disposed between, and secured to, first HVAC unit 1205 and second HVAC unit 1210. In various other embodiments, first unit 1205 and second unit 1210 may be units to be tested in operation together and air conveyance apparatus 100 may act as an air conveyance apparatus between units 1205 and 1210. Likewise, in a laboratory setting, or the like, first unit 1205 and second unit 1210 may be testing units, research units, or the like, joined by air conveyance apparatus 100 to act as an air conveyance apparatus between units 1205 and 1210.

Returning to FIG. 11, to assemble a HVAC system (1200) the assembled HVAC air conveyance apparatus (100) is disposed, at 1120, between a first HVAC unit (1205) and a second HVAC unit (1210), with HVAC unit mating flanges 114 extending from each other opposite edge 116 of each first and/or second quadrilateral panels (102 and 104, or 106) received securable by an open end of each of the first and second HVAC units (1205 and 1210). At 1125 the assembled HVAC air conveyance apparatus (100) is secured between the first HVAC unit (1205) and the second HVAC unit (1210) using a plurality of fasteners (1215) through (a side of the respective HVAC unit and) the HVAC unit mating flanges (114). In accordance with various embodiments of the present systems and methods, the installer may also employ tape with the intentions of sealing and further adhering the air conveyance apparatus (100) in place to the adjacent/connected HVAC appliance (1205 and/or 1210). The installer, operator, or customer may also adhere tape within the inside of the unit(s) (1205 and/or 1210) and/or the air conveyance apparatus (100), in order to further seal the air conveyance apparatus in-line with connected HVAC components (1205 and/or 1210).

The order in which each operation of a given method is performed may be changed, and various operations may be added, reordered, combined, omitted, modified, etc. It is intended that embodiment(s) described herein embrace all such modifications and changes and, accordingly, the above description should be regarded in an illustrative rather than a restrictive sense.

After assembly the combined components of the unit combine and yield benefits such as improved system efficiency, in that, the assembled system maintains SEER, air flow distribution, heating element exposure, and the like. Further, the combined component unit yield minimized system resistance to the system(s), such as minimized turbulence, minimized minor dynamic pressure loss, minimized flow resistance. Improved service accessibility to the system(s) is also provided in the combined component unit, including a large removable panel (door 118). The combined component unit further yields attenuated sound power of system(s) during operation, so as to provide an increased Sound Transmission Class (STC), increased Noise Reduction Coefficient (NRC), and/or the like. The combined component unit also yields improved resistance to fungi and/or bacteria growth between systems. For example, the combined component unit has low moisture absorption, and thus, eliminates harboring of potential biological life. Improved passive fire protection of system(s) and the associated structure, in the combined component unit is non-combustible. The combined component unit further provides reduced (risk of) chemical exposure and deposition throughout the system(s) and structure, in that certified insulation, or the like, used in the combined component unit is proven to reduce indoor air pollution, and the like.

Leak testing was conducted on an embodiment of the present air conveyance apparatus. The apparatus was assembled on site, as is intended to be done by an installer or operator at the scene of installation, and then subjected to internal flow by fans that replicate typical HVAC flow parameters. Using various instrumentation, volumetric flow rates were captured by testing facility provided vent hoods in such a way that recorded air successfully channeled through the apparatus, as well as air that escaped through the confines of the apparatus. Under steady state volumetric flow of 1600 cubic feet per minute, both volumetric flow rates of channeled air and leaked air were recorded simultaneously. The following results were obtained: 7 CFM of leakage during 1600 CFM of flow at an internal positive pressure of 0.23 inches water column (W.C.); 14.5 CFM of leakage during 1600 CFM of flow at an internal positive pressure of 0.51 inches W.C. and 32.25 CFM of leakage during 1600 CFM of flow at an internal positive pressure of 1.27 inches W.C. Thereby, sealing of the assembled air conveyance apparatus, as described above was confirmed.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A heating, ventilation and air conditioning air conveyance apparatus comprising:

a plurality of panels adapted to be field-assembled to form the heating, ventilation and air conditioning air conveyance apparatus the plurality of panels comprising:

a pair of first quadrilateral panels, each first quadrilateral panel defining a right-angle flange extending from each of a pair of opposite edges;

a pair of second quadrilateral panels, each second quadrilateral panel defining a hemmed cleat along each of a pair of opposite edges, each hemmed cleat shaped and dimensioned to receive one of the first quadrilateral panel right-angle flanges, each hemmed cleat comprising a screw receptive pilot hole configured to receive a fastener to secure a first quadrilateral panel right-angle flange received in the hemmed cleat slot, to form the heating, ventilation and air conditioning air conveyance apparatus; and heating, ventilation and air conditioning unit mating flanges extending from each other edge of each of the first quadrilateral panels and/or from each other edge of each of the second quadrilateral panels, such that at least a pair of opposed peripheral heating, ventilation and air conditioning unit mating flanges extend from each end of the heating, ventilation and air conditioning air conveyance apparatus.

2. The heating, ventilation and air conditioning air conveyance apparatus of claim 1, wherein each hemmed cleat further comprises:

a butt end extending generally perpendicular from a face of the respective second quadrilateral panel and along and spaced apart from the respective edge of the pair of opposite edges of the respective second quadrilateral panel; and a projecting lip extending from the butt end, generally parallel to the face of the respective second quadrilateral panel, toward the respective edge of the pair of opposite edges of the respective second quadrilateral panel, spaced apart from the face of the respective second quadrilateral panel a distance to define a first quadrilateral panel right-angle flange receptive hemmed cleat slot sized to receive one of the first quadrilateral panel right-angle flanges.

3. The heating, ventilation and air conditioning air conveyance apparatus of claim 2, wherein each screw receptive pilot hole is defined through the projecting lip.

4. The heating, ventilation and air conditioning air conveyance apparatus of claim 3, wherein each first quadrilateral panel right-angle flange further comprises a right-angle flange screw receptive pilot hole defined through the first quadrilateral panel right-angle flange, the right-angle flange screw respective pilot hole spaced to align with the screw receptive pilot hole defined through the projecting lip when the first quadrilateral panel right-angle flange is received in the hemmed cleat slot defined by the projecting lip, and the right-angle flange screw respective pilot hole sized to threadably receive the fastener to form the heating, ventilation and air conditioning air conveyance apparatus.

5. The heating, ventilation and air conditioning air conveyance apparatus of claim 1, wherein:

each panel of the plurality of panels is generally trapezoidal in shape;

each other edge of each first quadrilateral panel and each other edge of each second quadrilateral panel are trapezoidal bases for each panel; and each edge of the pair of opposite edges of each first quadrilateral panel and each edge of the pair of opposite edges of each second quadrilateral panel are trapezoidal legs for the respective panel.

6. The heating, ventilation and air conditioning air conveyance apparatus of claim 5, wherein each panel of the plurality of panels is generally isosceles trapezoidal in shape.

7. The heating, ventilation and air conditioning air conveyance apparatus of claim 1, wherein at least one of the panels of the plurality of panels comprises an access door.

8. The heating, ventilation and air conditioning air conveyance apparatus of claim 1, further comprising insulation panels disposed on an inner surface of each panel of the plurality of panels forming the heating, ventilation and air conditioning air conveyance apparatus.

9. The heating, ventilation and air conditioning air conveyance apparatus of claim 8, further comprising an air purification coating disposed on an inner surface of the insulation panels and thus on an inner surface of the heating, ventilation and air conditioning air conveyance apparatus.

10. The heating, ventilation and air conditioning air conveyance apparatus of claim 1, further comprising an air purification coating disposed on an inner surface of each panel of the plurality of panels forming the heating, ventilation and air conditioning air conveyance apparatus.

11. The heating, ventilation and air conditioning air conveyance apparatus of claim 1, wherein each panel of the plurality of panels is comprised of sheet metal.

12. The heating, ventilation and air conditioning air conveyance apparatus of claim 11, wherein the sheet metal is galvanized sheet metal.

13. The heating, ventilation and air conditioning air conveyance apparatus of claim 11, wherein the sheet metal is aluminum.

14. The heating, ventilation and air conditioning air conveyance apparatus of claim 11, wherein the sheet metal is stainless steel, powder coated steel or pre-painted steel.

15. A method comprising:

assembling a pair of first quadrilateral panels to a pair of second quadrilateral panels to form a heating, ventilation and air conditioning air conveyance apparatus, comprising:

inserting a right-angle flange extending from each of a pair of opposite edges of each of the first quadrilateral panels into a hemmed cleat defined along each of a pair of opposite edges of each of a respective one of the second quadrilateral panels; and securing each of the first quadrilateral panels to the respective one of the second quadrilateral panels with a fastener received through a pilot hole defined through a projecting lip of the hemmed cleat of each of the second quadrilateral panels into the right-angle flange extending from the respective one of the first quadrilateral panels.

16. The method of claim 15 wherein the method further comprises preparing the pair of first quadrilateral panels and the pair of second quadrilateral panels for transportation, comprising, prior to assembling the pair of first quadrilateral panels to the pair of second quadrilateral panels, alternately stacking one of the first quadrilateral panels, one of the second quadrilateral panels, the other of the first quadrilateral panels, and the other of the second quadrilateral panels.

17. The method of claim 15, further comprising receiving the fastener through the pilot hole defined through the projecting lip of the hemmed cleat of each of the second quadrilateral panels into a screw receptive pilot hole defined in the right-angle flange extending from the respective one of the first quadrilateral panels.

18. The method of claim 15, further comprising assembling a heating, ventilation and air conditioning system comprising:

disposing a resultingly assembled heating, ventilation and air conditioning air conveyance apparatus between a first heating, ventilation and air conditioning unit and a second heating, ventilation and air conditioning unit, with heating, ventilation and air conditioning unit mating flanges extending from each other opposite edge of each first and/or second quadrilateral panels received securably by an open end of each of the first and second heating, ventilation and air conditioning units; and securing the assembled heating, ventilation and air conditioning air conveyance apparatus between the first heating, ventilation and air conditioning unit and the second heating, ventilation and air conditioning unit air conveyance apparatus using a plurality of fasteners through the heating, ventilation and air conditioning unit mating flanges.

19. A heating, ventilation and air conditioning system comprising:

a first heating, ventilation and air conditioning unit;

a second heating, ventilation and air conditioning unit; and a heating, ventilation and air conditioning air conveyance apparatus disposed between, and secured to, the first heating, ventilation and air conditioning unit and the second heating, ventilation and air conditioning unit, the air conveyance apparatus comprising:

a plurality of panels adapted to be field-assembled to form the heating, ventilation and air conditioning air conveyance apparatus, each panel comprising an air purification coating disposed on an inner surface, and the plurality of panels comprising:

a pair of first quadrilateral panels, each first quadrilateral panel defining a right-angle flange extending from each of a pair of opposite edges;

a pair of second quadrilateral panels, each second quadrilateral panel defining a hemmed cleat along each of a pair of opposite edges, each hemmed cleat shaped and dimensioned to receive one of the first quadrilateral panel right-angle flanges to form the heating, ventilation and air conditioning air conveyance apparatus; and heating, ventilation and air conditioning unit mating flanges extending from each other edge of each of the first quadrilateral panels and/or from each other edge of each of the second quadrilateral panels, such that at least a pair of opposed peripheral heating, ventilation and air conditioning unit mating flanges extend from each end of the heating, ventilation and air conditioning air conveyance apparatus and is received securably by an open end of each of the first and second heating, ventilation and air conditioning units.

20. The heating, ventilation and air conditioning system of claim 19, wherein each hemmed cleat further comprises:

a butt end extending generally perpendicular from a face of the respective second quadrilateral panel and along and spaced apart from the respective edge of the pair of opposite edges of the respective second quadrilateral panel;

a projecting lip extending from the butt end, generally parallel to the face of the respective second quadrilateral panel, toward the respective edge of the pair of opposite edges of the respective second quadrilateral panel, spaced apart from the face of the respective second quadrilateral panel a distance to define a first quadrilateral panel right-angle flange receptive hemmed cleat slot sized to receive one of the first quadrilateral panel right-angle flanges; and a screw receptive pilot hole defined through the projecting lip configured to receive a fastener to secure a first quadrilateral panel right-angle flange received in the hemmed cleat slot, to form the heating, ventilation and air conditioning air conveyance apparatus.

* * * * *